United States Patent [19]

Ozmon et al.

[11] Patent Number: 4,549,688

[45] Date of Patent: Oct. 29, 1985

[54] EXPANDABLE FILE FOLDER

[76] Inventors: Laird M. Ozmon, 1130 N. Dearborn, Chicago, Ill. 60610; Stephen R. Welch, 1227 S. Wilke #110, Arlington Hts., Ill. 60005

[21] Appl. No.: 526,862

[22] Filed: Aug. 26, 1983

[51] Int. Cl.[4] ..... B65D 5/18

[52] U.S. Cl. ..... 229/1.5 R; 229/68 R; 229/41 B

[58] Field of Search ..... 229/68 R, 41 B, 1.5 R; 383/106

[56] References Cited

U.S. PATENT DOCUMENTS

| | | | |
|---|---|---|---|
| D. 219,266 | 11/1970 | Biallo . | |
| 916,503 | 3/1909 | Thompson | 229/68 R |
| 1,112,042 | 9/1914 | Ullman | 229/68 R |
| 1,317,261 | 9/1919 | Bagley | 229/68 R |
| 1,613,570 | 1/1927 | Shotwell . | |
| 1,634,064 | 6/1927 | Ahlquist . | |
| 2,270,343 | 1/1942 | Ringler | 229/41 B |
| 2,519,405 | 8/1950 | Schwinger . | |
| 2,631,772 | 3/1953 | Hiersteiner . | |
| 2,645,405 | 7/1953 | Dorfman | 229/41 B |
| 2,704,184 | 3/1955 | Martin . | |
| 3,039,674 | 6/1962 | Krueger | 229/68 R |
| 3,073,508 | 1/1963 | Hiersteiner . | |
| 3,074,618 | 1/1963 | Shepard . | |
| 3,256,527 | 6/1966 | Studen . | |
| 3,351,064 | 11/1967 | Cohn | 383/106 |
| 3,446,421 | 5/1969 | Carrigan et al. . | |
| 3,565,325 | 2/1971 | Pugsley | 229/41 B |
| 3,642,191 | 2/1972 | Roof . | |
| 3,658,239 | 4/1972 | Fautz . | |
| 3,885,726 | 5/1957 | Fridlund et al. . | |
| 4,094,458 | 6/1978 | Nelson | 229/41 B |
| 4,149,667 | 4/1979 | Riley . | |
| 4,169,539 | 10/1979 | Price . | |
| 4,262,838 | 4/1981 | Mackenzie . | |

FOREIGN PATENT DOCUMENTS

| | | | |
|---|---|---|---|
| 426682 | 4/1935 | United Kingdom | 229/72 |

*Primary Examiner*—Stephen P. Garbe

*Attorney, Agent, or Firm*—Welsh & Katz, Ltd.

[57] ABSTRACT

An expandable file folder made from a substantially unitary blank of relatively stiff sheet plastic and having a front panel, a rear panel, a rectangular bottom wall connected along opposite marginal edges to the front and rear panels along fold lines, and end walls connected to opposite transverse edges of a selected one of the front and rear panels and having their free edges connected to connecting tabs formed on the other of the front and rear panels. A tucking flap is hingedly connected to a lower transverse edge of each of the end walls and is positionable to overlie the bottom wall so as to provide additional supporting strength for the bottom wall. The bottom and end walls preferably have fold lines along their longitudinal centerlines which enable lateral expansion and compressing of the file folder. A top closure flap is integrally connected to the upper edge of the rear panel and has an intermediate fold line enabling a portion of the closure flap to be folded into juxtaposed relation with the front panel. A transparent pocket is preferably formed on the front panel to enable insertion of a file indicia card or the like.

9 Claims, 10 Drawing Figures

Fig. 1.
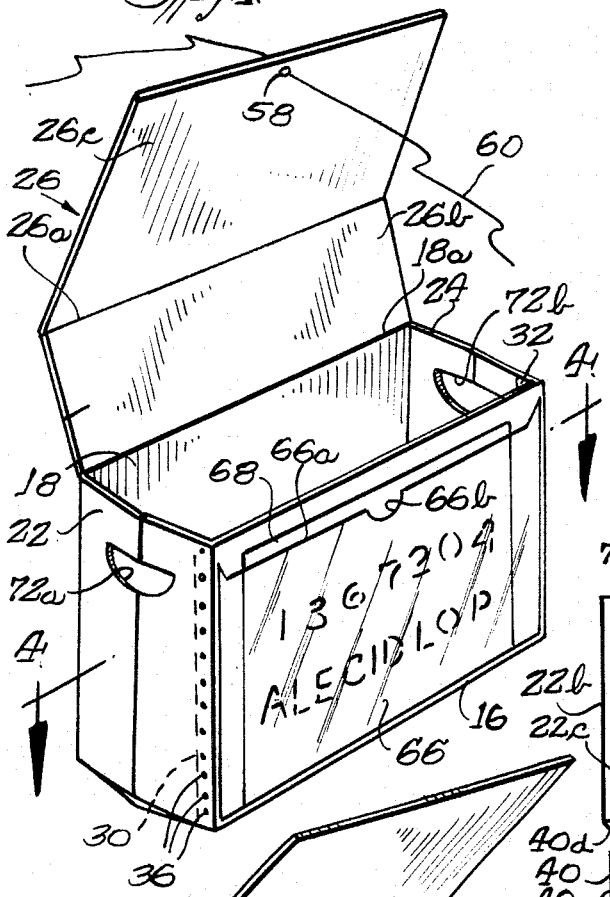
Fig. 2.
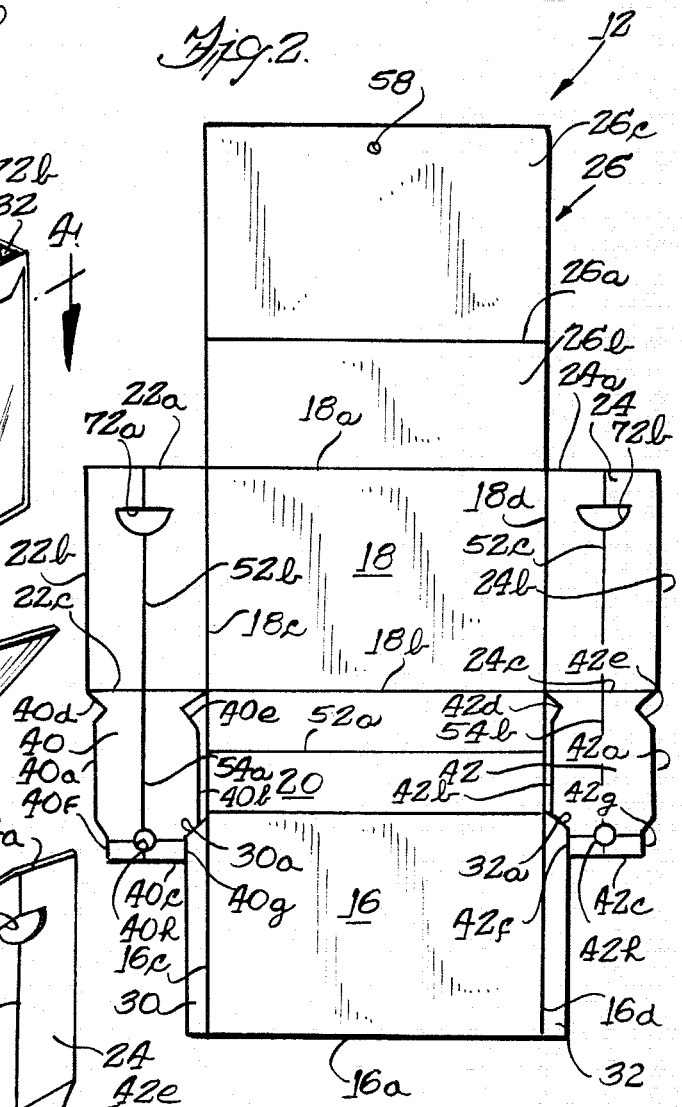
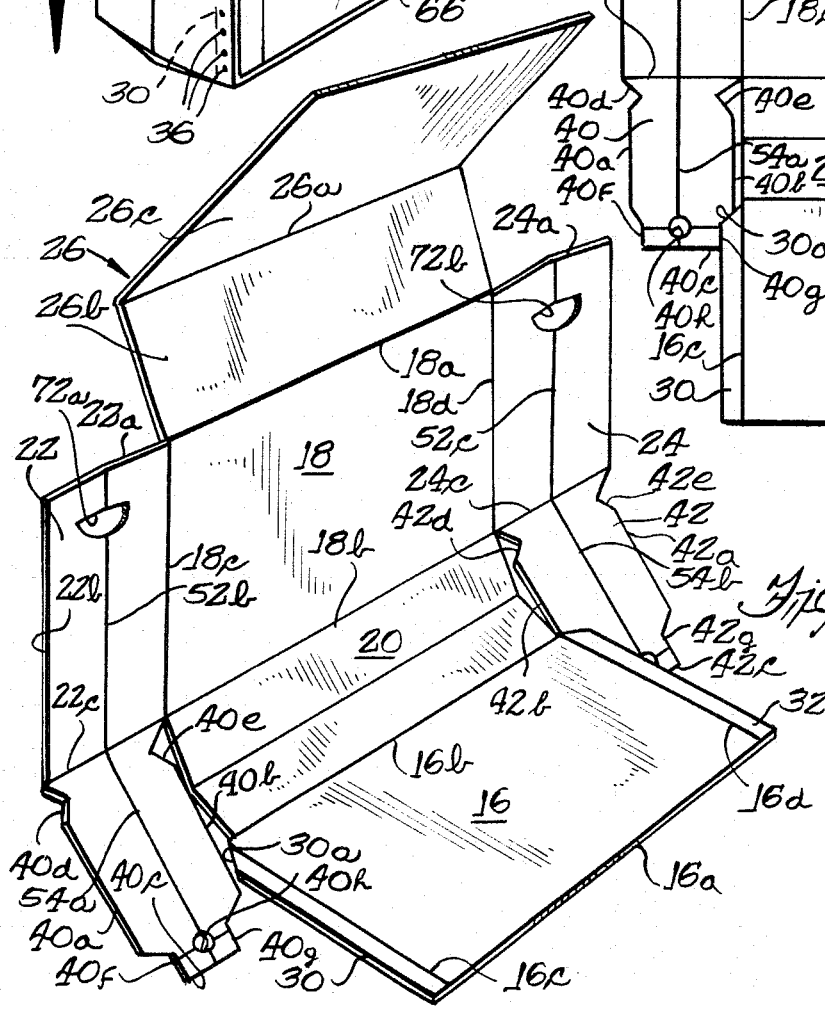
Fig. 3.

40e 18 40g 42f 42d
40 40c 46
40h 42h
42
52b 52c
22 54a 42c 54b 24
30 32
20 40d 16 40f 40g 42e 30 52b 22 66 52a 20 40d 40b 16 40e 40a 40 40f 40c 40h 40g 22 52b 30 40b 40d 16 40 40e 54a 40f 40a 66 22 40 16 20

48 42'
42'h
40'h 20'
40' 48a 26b 26 18a 26a 22 72a 62a 26c 52b 62b 16

40' 42'h 48 42'
40'h 48a 20'

EXPANDABLE FILE FOLDER

BACKGROUND OF THE INVENTION

The present invention relates generally to file folders, and more particularly to an expandable file folder made from a unitary blank of durable plastic material and having novel construction features providing substantially greater support strength than found in prior expandable file folders.

It is a common practice in commercial business establishments to employ expandable file folders for storing generally flat papers and the like so as to facilitate retention of the papers in desired subject matter categories for ready access. Such file folders are particularly desirable in business offices to enable storage of generally flat papers in upstanding face-to-face relation in selected subject matter files so as to optimally utilize available storage space such as on horizontal shelves and the like. While prior known expandable file folders have proven generally acceptable, they exhibit a number of substantial drawbacks. For example, the known expandable file folders which are of sufficient volumetric capacity to contain a significant number of generally flat papers and the like have, for the most part, exhibited relatively short useful lives when subjected to frequent handling due to their relatively low strength and inability to resist tearing or ripping, particularly in the area of their bottom walls when loaded to near capacity.

SUMMARY OF THE INVENTION

One of the primary objects of the present invention is to provide a novel expandable file folder made from a substantially unitary blank of relatively stiff durable plastic sheet material, the file folder having a construction which provides significant strength advantages over prior expandable file folders.

A more particular object of the present invention is to provide an expandable file folder made from a relatively rigid plastic sheet material and having a front panel, a rear panel, a generally rectangular bottom wall integrally connected to the front and rear panels along opposite marginal fold lines, and an end wall connected through a fold line to each of the opposite transverse edges of a selected one of the front and rear panels such that the end walls may be folded for connection of their free edges to an opposed connecting tab formed on the other of the front and rear panels. Each of the end walls has a tucking flap formed integrally therewith which is adapted to be positioned in overlying juxtaposed relation to the bottom wall so as to provide additional supporting strength for the bottom wall when the file folder is in assembled relation. A top closure flap enables the top to be selectively closed.

A feature of the expandable file folder in accordance with the present invention lies in facilitating connection of adjacent ends of the tucking flaps when in overlying relation on the bottom wall so as to provide additional supporting strength for the file folder.

Another feature of the invention lies in the provision of central fold lines longitudinally of the bottom and end walls of the tucking flaps so as to facilitate expansion and lateral compressing of the front and rear panels.

Further objects, features and advantages of the file folder in accordance with the present invention will become apparent from the following detailed description of preferred embodiments thereof when taken in conjunction with the accompanying drawings wherein like reference numerals designate like elements throughout the several views.

BRIEF DESCRIPTION OF THE DRAWINGS

FIG. 1 is a perspective view of an expandable file folder constructed in accordance with the present invention, the top closure flap being shown in an open position;

FIG. 2 is a plan view of an integral blank sheet of material from which the file folder of FIG. 1 is assembled;

FIG. 3 is a perspective view of the blank shown in FIG. 2, but with the various portions shown during folding into the file folder of FIG. 1;

DESCRIPTION OF PREFERRED EMBODIMENTS

Figures 4, 5, 6, 7, 8, 9, 10:
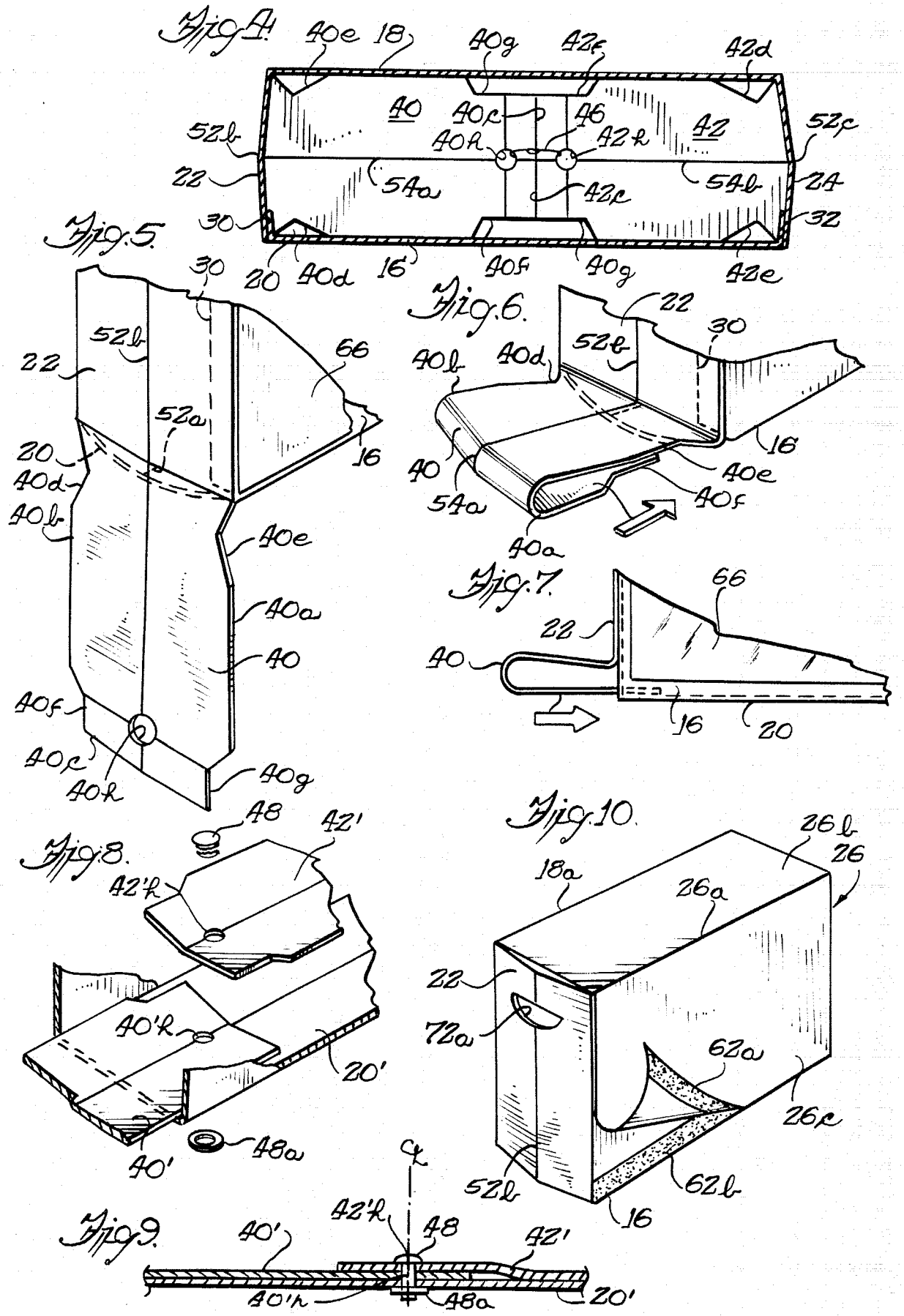
FIG. 4 is a transverse sectional view taken substantially along line 4—4 of FIG. 1 and illustrating the tucking flaps in overlying relation against the bottom wall of the file folder.
FIG. 5 is a fragmentary perspective view illustrating a tucking flap prior to tucking to overlie the bottom wall of the file folder.
FIG. 6 is a fragmentary perspective view illustrating an intermediate position of the tucking flap of FIG. 5 during tucking to overlie the bottom wall of the file folder.
FIG. 7 is a fragmentary elevational view illustrating an advanced position of the tucking flap during tucking to overlie the bottom wall of the file folder.
FIG. 8 is a fragmentary exploded perspective view illustrating an alternative embodiment wherein the ends of the tucking flaps overlap to facilitate connection to the bottom wall of the file folder.
FIG. 9 is a fragmentary sectional view illustrating the tucking flaps of FIG. 8 in connected relation.
FIG. 10 is a perspective view of the file folder of FIG. 1 but showing an alternative manner of securing the top closure flap in closed position.

Referring now to the drawings, an expandable file folder constructed in accordance with one embodiment of the present invention is indicated generally at 10 in FIG. 1. The expandable file folder 10 is made from a substantially unitary or integral flat blank of relatively rigid sheet material as indicated generally at 12 in FIGS. 2 and 3. The blank 12 is preferably made from relatively rigid or stiff plastic sheet material such as a suitable polyethylene or other suitable relatively heavy gauge plastic which exhibits high resistance to abrasion and tearing.

With particular reference to FIGS. 2 and 3, taken in conjunction with FIG. 1, the blank 12 defines a substantially rectangular front panel 16, a rectangular rear panel 18, a rectangular bottom wall 20, end walls 22 and 24 and a top closure flap 26. The front panel 16 is defined by parallel longitudinal fold lines **16*a* and 16*b*, which may be termed the upper and lower longitudinal edges, respectively. The longitudinal edge or fold line 16*b* forms an integral connection between the front panel 16 and the bottom wall 20**.

The rear or back panel 18 is of substantially identical size and configuration to the front panel 16 and has upper and lower longitudinal edges **18*a* and 18*b* which are disposed parallel to the longitudinal edges 16*a,b* of the front panel 16. The edge 18*b* of the rear panel 18** defines a fold line which forms an integral connection between the rear panel and the bottom wall 20. For purposes of description, the fold lines 16*b* and 18*b* and any other lines in the planes of corresponding panels 16 and 18 which lie parallel to the fold lines 16*b* and 18*b* are considered as extending parallel to the longitudinal axes of the panels 16 and 18. In the illustrated embodiment, the rectangular end walls 22 and 24 are formed integral with the rear panel 18 and have their major length axes disposed substantially transverse to the longitudinal axis of the rear panel. The end walls 22 and 24 are connected to the rear panel 18 through fold lines 18*c* and 18*d* which form the opposite transverse end edges of the rear panel 18. The end walls 22 and 24 are foldable to positions lying in planes substantially normal to the plane of the rear panel 18 when the blank 12 is assembled.

The end walls 22 and 24 have upper free edges 22*a* and 24*a*, respectively, which are coextensive with the upper edge 18*a* of the rear panel 18. The end walls 22 and 24 have free outer edges 22*b* and 24*b*, respectively, which facilitate connection of the end walls to the front panel 16 when the blank 12 is folded to form the file folder 10. To this end, the front panel 16 has a pair of laterally opposite connecting tabs 30 and 32 which are hingedly connected to the front panel 16 through fold lines 16*c* and 16*d* disposed transverse or normal to the major longitudinal axis of the front panel. The connecting tabs 30 and 32 extend substantially the full transverse width of the front panel 16 and terminate adjacent the fold line 16*b* in beveled edges 30*a* and 32*a*, respectively. The connecting tabs 30 and 32 are foldable to positions lying at right angles to the plane of the front panel 16 for connection to the end walls 22 and 24, as will be described.

The various aforementioned fold lines formed in the blank 12 may be established in a conventional manner such as by scoring the plastic sheet material along the fold lines in the surface of the blank which will become the outer surface of the assembled container. Stated alternatively, the fold lines are coextensive with score lines formed in the plastic sheet in the surface thereon which will become the outer convex edge of the fold.

To assemble the blank 12 into an expandable file folder such as illustrated in FIG. 1, the front panel 16 and bottom wall 20 are folded about their respective fold lines 16*b* and 18*b* such that the bottom wall lies in a plane normal to the rear panel 18 and the front panel 16 extends upwardly and forwardly from the rear panel and in substantially parallel relation thereto. The connecting tabs 30 and 32 are folded about their respective fold lines 16*c* and 16*d* to lie substantially normal to the front panel 16 while the end walls 22 and 24 are folded about their respective fold lines 18*c* and 18*d* to lie generally normal to the rear panel 18 with the connecting tabs 30 and 32 lying inwardly of the marginal edges 22*b* and 24*b* of the end walls. When it is desired to provide the file folder 10 in a pre-assembled condition, the plastic connecting tabs 30 may be suitably connected to the marginal edges 22*b* and 24*b* of the end walls 22, 24 as through sonic welding, such as indicated by sonic spot welds 36 in FIG. 1, in accordance with conventional sonic welding techniques. It will be understood that eyelets or grommets or like fasteners could also be used to secure the tabs 30 and end walls 22, 24 in place of sonic spot welds.

When it is desired to provide the file folder 10 in a substantially flat condition for purposes of transportation and minimal storage shelf space, suitable fasting means, such as plastic rivets of known design, may be provided with the blank 12 for use by the purchaser to secure the connecting tabs 30 and 32 to the marginal edges 22*b* and 24*b* of the end walls 22, 24. It will be understood that if separate fastening means such as plastic rivets or the like are employed as aforementioned, suitable openings would be provided along the lengths of the connecting tabs for alignment with correspondingly positioned openings along the marginal edges 22*b* and 24*b* of the end walls.

In accordance with one feature of the expandable file folder 10, each of the end walls 22 and 24 has a tucking flap, indicated at 40 and 42, respectively, hingedly connected to a lower transverse edge of the associated end wall through a score or fold line as indicated at 22*c* and 24*c*, respectively. In the illustrated embodiment, each of the tucking flaps 40 and 42 is of generally rectangular configuration and has a longitudinal length, considered as the length of the major center line thereof, equal to substantially one-half the longitudinal length of the bottom wall 20. Each of the tucking flaps 40 and 42 further has longitudinal edges indicated at 40*a,b* and 42*a,b*, respectively, which establish a transverse width for the associated tucking flap slightly less than the transverse width of the corresponding end wall 22,24 which it is hingedly connected.

In the assembly of the blank 12 to form the expandable file folder 10, the tucking flaps 40 and 42 are manipulated so as to overlie the bottom wall 20, as illustrated in FIG. 4, with the free transverse end edges 40*c* and 42*c* of the tucking flaps disposed in closely spaced or substantially abutting edge-to-edge relation. To facilitate folding of the tucking flaps to overlie the bottom wall 20 of the file folder, each of the tucking flaps is preferably formed with notched recesses such as indicated, respectively, at 40*d*, 40*e* and 42*d*, 42*e*. The free ends of the tucking flaps 40 and 42 are also preferably reduced in lateral width so as to define lead-in edges 40*f*, 40*g* and 42*f*, 42*g*. As illustrated in FIG. 2, the end edges 40*g* and 42*f* are formed in part by the die-cut lines of the blank 12 which establish the beveled edges 30*a* and 32*a* of the connecting tabs 30 and 32, respectively.

FIGS. 4–6 illustrate insertion of the tucking flap 40 after affixing the connecting tabs 30 and 32 to the marginal edges 22*b* and 24*b* of the end walls 22 and 24 following which the tucking flaps extend in generally coplanar relation with the associated end walls as shown in FIG. 5. The lower end of each of the tucking flaps is folded upwardly and inserted into the slot established between the corresponding fold lines 22*c*, 24*c* and the bottom wall 20, after which the tucking flap is fully inserted so as to substantially fully overlie approximately one-half the area of the underlying bottom wall 20.

To further strengthen the bottom wall 20 and to provide additional load supporting strength for any contents within the file folder during use, the free ends of the tucking flaps 40 and 42 may be connected together after insertion to overlie the bottom wall 20. In the illustrated embodiment, each of the tucking flaps 40 and 42 has a circular opening or aperture, indicated respectively at 40*h* and 42*h*, through which a tie band or heavy string-like element 46 (FIG. 4) may be looped and tied to generally releasably affix the ends of the tucking flaps together.

FIG. 8 illustrates an alternative embodiment wherein tucking flaps, indicated generally at 40' and 42', are made slightly longer in longitudinal length than the aforedescribed tucking flaps 40 and 42 such that the free ends of the tucking flaps 40', 42' overlap with their circular openings or apertures 40'h and 42'h in aligned relation to enable insertion of a suitable connector such as a plastic rivet or the like 48. Preferably, the bottom wall 20' is also provided with a generally circular opening to underlie the aligned openings 40'h and 42'h so as to enable the rivet or fastener 48 to extend through the corresponding opening in the bottom wall for receipt of an annular ring retainer or fastener portion 48a. In this manner, the tucking flaps 40' and 42' are rigidly secured to the bottom wall 20' so as to add supporting strength and rigidity thereto with resulting prolonged life of the corresponding file folder.

To facilitate lateral expansion and compressing or collapsing of the file folder 10 after assembly, the bottom wall 20 and end walls 22 and 24 are preferably provided along their longitudinal centerlines with fold or score lines, indicated in FIG. 2 at 52a, 52b and 52c, respectively. The fold lines 52a–c are formed in the outer exposed surfaces of the bottom and end walls so as to allow outward expansion or folding thereof with corresponding movement of the front and rear panels 16 and 18 toward and away from each other as may occur in relation to the width of the materials placed within the file folder.

To optimize the expanding and compressing feature of the file folder 10, similar external fold or score lines, indicated at 54a and 54b, are formed in the external surfaces of the tucking flaps 40 and 42 along their longitudinal centerlines so as to facilitate folding or collapse of the tucking flaps when positioned in overlying relation on the bottom wall 20. If it is not desired to provide for such expanding or collapsing of the end and bottom walls, the score line 52a–c might be eliminated.

The folding closure top or flap 26 is integrally connected to the upper edge 18a of the rear panel 18 through a fold or score line enabling the closure flap to be folded relative to the rear panel. Preferably, the closure flap 26 has an intermediate fold or score line 26a formed transversely thereof parallel to the fold line 18a so as to define a top closure portion 26b and a forward folding flap 26c. The portion 26b of the closure flap has a transverse width, considered as the distance between the fold lines 18a and 26a, substantially equal to the transverse width of the bottom wall 20, while the flap portion 26c may have an area substantially equal to the area of the front panel 16.

In the embodiment illustrated in FIG. 1, the closure flap portion 26c has a suitable opening 58 formed therethrough to receive a tie string 60 which facilitates tying down of the closure flap in a closed position with the tie string extending about the circumference of the file folder. Alternatively, the tie string 60 may comprise an endless elastic band, frequently termed a "banjo string", having sufficient elasticity to extend about the circumference of the file folder in both its collapsed and expanded positions.

FIG. 10 illustrates an alternative embodiment wherein the closure flap portion 26c and the lower edge of the front panel 16 have mutually cooperable releasable fastening means in the form of Velcro strips 62a and 62b which facilitate releasable securing of the free edge of the closure flap to the lower edge of the front panel 16. It will be appreciated that the flap portion 26c may be inserted downwardly internally of the front panel 16 without securing the closure flap with either a tie string, an elastic band or releasable fastening means as illustrated in FIG. 10.

In accordance with another feature of the file folder 10, a transparent pocket is formed on the outer surface of the front panel 16 to facilitate insertion of a card or sheet on which informational data may be recorded identifying the contents of the file folder and which is readable through the transparent pocket. The transparent pocket may be formed by affixing a sheet 66 of a suitable transparent material, such as transparent plastic, along its bottom and opposite transverse end edges to the underlying front panel 16 of the file folder, as through a suitable heat seal or bonding agent, as is known. An upper edge 66a of the transparent sheet 66 preferably has a finger recess 66b formed therein which facilitates removal of the data card 68.

In accordance with still another feature of the file folder 10, each of the end walls 22 and 24 has a suitable handle opening formed therethrough such as a generally semi-circular opening shown at 72a and 72b, respectively, which enables the user to insert fingers through the handle openings for lifting and handling the file folder.

In one embodiment of the file folder 10, the front and rear panels 16 and 18 were formed with longitudinal lengths of approximately 15" and with transverse widths or heights of approximately 9½". The bottom wall 20 and end walls 22 and 24 were formed with transverse widths of approximately 5", as was the closure portion 26b of the closure flap 26. The flap portion 26c of the closure top was formed with longitudinal and transverse dimensions approximately equal to the corresponding dimensions of the front and rear panels 16 and 18. In this manner, when assembled, the expandable file folder 10 provides substantial storage capacity when in its fully expanded position, but may be collapsed to a lesser lateral width when not fully loaded so as to minimize storage space requirements.

While various preferred embodiments of the expandable file folder in accordance with the present invention have been illustrated and described, it will be understood that changes and modifications may be made therein without departing from the invention in its broader aspects. Various features of the invention are defined in the following claims.

What is claimed is:

1. An expandable file folder made from a substantially unitary blank of relatively stiff sheet plastic or the like defining;

a front panel, a rear panel, said front and rear panels being of substantially identical generally rectangular size and having upper and lower longitudinal edges and transverse end edges, a rectangular bottom wall connected along opposite marginal edges to said front and rear panels along fold lines, said bottom wall having a longitudinal fold line substantial midway between its said marginal edges, a selected one of said front and rear panels having an end wall connected to each of its opposite transverse end edges through a fold line, each of said end walls having a generally central fold line extending longitudinally thereof, and having a lower transverse edge coextensive with the lower longitudinal edge of the selected panel, the other of said front and rear panels having a connecting tab hingedly connected to each of its opposite transverse end edges in a manner to enable folding of said connecting tabs for connection to a corresponding one of said end walls, a top closure flap connected to the upper longitudinal edge of said rear panel in a manner enabling folding of said closure flap so that a portion thereof lies in juxtaposed relation with said front panel, and a generally rectangular tucking flap hingedly connected to the lower transverse edge of each of said end walls so as to enable folding to a position substantially normal to the plane of the corresponding end wall, said tucking flaps each having opposite substantially parallel free edges defining a lateral width less than the lateral width of the corresponding end wall and being removably positionable to overlie said bottom wall in juxtaposed relation therewith, each of said tucking flaps further having a longitudinal length sufficient to overlie at least one-half the length of said bottom wall when in said overlying relation therewith so as to provide additional supporting strength for said bottom wall, each of said tucking flaps having a longitudinal fold line generally central thereof to facilitate collapse of said file folder when said connecting tabs are connected to the corresponding end walls but prior to positioning of said tucking flaps in said overlying relation with said bottom wall.

2. A file folder as defined in claim 1 wherein each of said tucking flaps has a free distal end adapted for juxtaposed relation with the free distal end of the other tucking flap when said tucking flaps are in said overlying relation to said bottom wall, and including means for connecting the free ends of said tucking flaps together.

3. A file folder as defined in claim 2 wherein said tucking flaps have longitudinal lengths such that their free ends overlap when said tucking flaps are in juxtaposed relation with said bottom wall, said connecting means including a connecting pin fixing said overlapped ends in attached relation.

4. A file folder as defined in claim 1 including a front viewing pouch formed on said front panel and adapted to receive an indicia card or the like therein.

5. A file folder as defined in claim 4 wherein said viewing pouch is defined by a transparent sheet of substantially equal size to said front panel, said transparent sheet being secured about three edges to said front panel and defining with said front panel a pouch having an access opening.

6. A file folder as defined in claim 1 including a lift opening formed in each of said end walls.

7. A file folder as defined in claim 1 including fastener means cooperative with said closure flap in a manner to enable releasable securing of said closure flap in closed position.

8. A file folder as defined in claim 7 wherein said closure flap defines a portion of substantially equal size to said front panel and adapted to be positioned in juxtaposed relation to said front panel.

9. An expandable file folder as defined in claim 1 wherein each of said tucking flaps has a free distal end defining a leadin end having a lateral width less than the lateral width between said parallel free edges of the corresponding tucking flap.

* * * * *

UNITED STATES PATENT AND TRADEMARK OFFICE

CERTIFICATE OF CORRECTION

PATENT NO. : 4,549,688

DATED : 10/29/85

INVENTOR(S) : Laird M. Ozmon, Stephen R. Welch

It is certified that error appears in the above-identified patent and that said Letters Patent is hereby corrected as shown below:

Column 1, line 62 "of" should be --and--.

Column 4, line 27 "which" should be --to which--.

Column 5, line 36 "line" should be --lines--.

Column 8, line 30 "leadin" should be --lead-in--.

Signed and Sealed this

Twenty-first Day of October, 1986

[SEAL]

*Attest:*

DONALD J. QUIGG

*Attesting Officer* *Commissioner of Patents and Trademarks*